US012378721B2

(12) United States Patent
García Victoria

(10) Patent No.: US 12,378,721 B2
(45) Date of Patent: Aug. 5, 2025

(54) METHOD FOR PROCESSING WOOL GARMENTS FOR INHIBITING THEIR SUBSEQUENT FELTING AND SHRINKAGE, AND A WOOL GARMENT TREATED BY THE METHOD

(71) Applicant: JEANOLOGIA, S. L., Paterna (ES)

(72) Inventor: Begoña García Victoria, Paterna (ES)

(73) Assignee: Jeanologia, S. L., Paterna (ES)

( * ) Notice: Subject to any disclaimer, the term of this patent is extended or adjusted under 35 U.S.C. 154(b) by 839 days.

(21) Appl. No.: 17/416,638

(22) PCT Filed: Dec. 20, 2019

(86) PCT No.: PCT/IB2019/061186

§ 371 (c)(1),
(2) Date: Jun. 21, 2021

(87) PCT Pub. No.: WO2020/129000

PCT Pub. Date: Jun. 25, 2020

(65) Prior Publication Data

US 2022/0074127 A1 Mar. 10, 2022

(30) Foreign Application Priority Data

Dec. 21, 2018 (EP) ..... 18382972

(51) Int. Cl.

| | |
|---|---|
| ***D06L 4/50*** | (2017.01) |
| ***D06L 4/29*** | (2017.01) |
| ***D06M 10/06*** | (2006.01) |
| ***D06M 11/34*** | (2006.01) |
| ***D06P 3/14*** | (2006.01) |
| ***D06P 5/12*** | (2006.01) |
| ***D06P 5/22*** | (2006.01) |
| *D06M 101/12* | (2006.01) |

(52) U.S. Cl.

CPC ..... *D06L 4/50* (2017.01); *D06L 4/29* (2017.01); *D06M 10/06* (2013.01); *D06M 11/34* (2013.01); *D06P 3/14* (2013.01); *D06P 5/22* (2013.01); *D06M 2101/12* (2013.01); *D06M 2200/45* (2013.01)

(58) Field of Classification Search

CPC ..... D06L 4/50; D06L 4/29; D06M 10/06; D06M 11/34; D06M 2101/12; D06M 2200/45; D06P 3/14; D06P 5/22

See application file for complete search history.

(56) References Cited

U.S. PATENT DOCUMENTS

| | | | | |
|---|---|---|---|---|
| 4,189,303 A | | 2/1980 | Thorsen | |
| 5,313,811 A | | 5/1994 | Wasinger et al. | |
| 5,529,928 A | * | 6/1996 | Ciampi | D06M 16/003 8/115.52 |
| 5,611,816 A | * | 3/1997 | Wasinger | D06P 5/02 8/102 |

FOREIGN PATENT DOCUMENTS

| | | | | |
|---|---|---|---|---|
| CN | 2271549 | * | 12/1997 | |
| FR | 2807076 | * | 10/2001 | D06M 11/34 |
| JP | 103146094 A | | 6/1991 | |
| JP | 2001-164460 A | | 6/2001 | |
| NZ | 521591 A | | 2/2004 | |
| TR | 201805107 | * | 5/2018 | |
| WO | WO-2011154277 A1 | * | 12/2011 | D06F 25/00 |

OTHER PUBLICATIONS

International Search Report and Written Opinion of the International Searching Authority issued on Apr. 2, 2020 in corresponding International application No. PCT/IB2019/061186; 8 pages.

Thorsen, "New aspects on the Ozonization of Wool", Textile Research Journal, 1965, vol. 35, pp. 638-647; 10 pages.

The Woolmark Company, Woolmark Test Method: Washing of Wool Textile Products, May 2000, pp. 1-19; 19 pages.

The Woolmark Company, Woolmark Specification Knitted Fabrics Specification SF-1 Effective Jan. 1, 2016; 10 pages.

* cited by examiner

*Primary Examiner* — Amina S Khan

(74) *Attorney, Agent, or Firm* — Maier & Maier, PLLC

(57) ABSTRACT

A method for the treatment of wool garments with ozone gas to control and inhibit their felting and shrinkage during their subsequent industrial finishing process and/or domestic washing care, and a wool garment treated with said method. The method includes wetting the garments and treating the garments inside the interior of a rotative tumbler for a time period of between 15 and 60 minutes at ambient temperature with ozone gas, the ozone gas being at a concentration in air of between 20 g ozone/$Nm^3$ and 150 g ozone/$Nm^3$, where the rotative tumbler which contains the garments is rotated at a speed of between 10 rounds/min and 25 rounds/min. The method is improved by adding treating the garments with enzymes.

14 Claims, 2 Drawing Sheets

METHOD FOR PROCESSING WOOL GARMENTS FOR INHIBITING THEIR SUBSEQUENT FELTING AND SHRINKAGE, AND A WOOL GARMENT TREATED BY THE METHOD

FIELD

The present invention relates to the technical field of the industrial processing of wool garments for controlling and inhibiting their subsequent felting and shrinkage. In particular, the invention relates to treating the wool garments with ozone gas for affecting the wool fibers for controlling, inhibiting and possibly completely preventing the felting and shrinkage of the garments during their subsequent finishing and washing in their industrial processing and/or their domestic use by their users.

BACKGROUND

Wool garments are known to be prone to felting and shrinkage during their industrial and domestic processing and finishing, and especially during their washing using industrial or domestic automated washing machines. It is generally believed that the aforementioned shrinkage and felting of wool garments is associated with the fact that the wool fibers of a garment get compacted and engage together during and as result of the industrial or domestic physicochemical treatments of the garment, some important examples of such treatments are the washing and the dyeing of the garment. The conditions to which the garments are subjected during said physicochemical treatments are generally believed to cause the increase of the friction and of the affinity in between the wool fibers, and this further causes the fibers to engage together and causes the aforementioned felting and shrinkage of the garments. Two major conditions that are commonly part of said processes and that contribute to the felting and shrinkage are first the mechanical forces acting on the garments and causing the abrasion of their wool fibers, and second the elevated temperatures. Such conditions can possibly change the surface morphology and/or microstructure of the wool fibers and more specifically, of the scales and/or platelets located on the surface of the wool fibers, in ways that cause the fibers to compact together and engage together and thus, cause the felting and shrinkage of the garments.

The felting and shrinkage of the garments are mostly undesired effects, because the manufacturers and users of the garments generally want to preserve and control the appearance and the morphology and the size of the garments, and prevent or inhibit their change. It is thus of significant industrial applicability the development of methods for inhibiting the felting and shrinkage of wool garments during their subsequent processing. It is further important to develop methods which additionally are environmentally friendly and are fast and can be scaled up in a cost effective way, because these qualities are further needed by the wool garment industry.

In the prior art there are known methods for inhibiting the felting and shrinkage of wool garments, but none of these methods has all of the aforementioned qualities. For example, there are known methods by which the felting and shrinkage of the wool garments is inhibited and prevented by processes involving the treatment of the garments with chlorine. Chlorine is known to cause the oxidation of the surface of the wool fibers and it is believed that this causes the aforementioned desired prevention of the felting and shrinkage of the wool garments. Nevertheless, the use of chlorine in the processing of garments is also known to have a significant negative environmental impact.

As an alternative to chlorine, aqueous solutions of ozone, which is another known strong oxidant, have also been suggested to prevent the felting and shrinkage of the wool garments treated with such solutions. For example, U.S. Pat. No. 4,189,303 describes the preparation and use of an aqueous solution of ozone for shrink-proofing animal fibers. Such process nevertheless, may be considered as suffering from the complexity associated with dissolving at sufficiently high and stable concentrations the ozone in water, and the complexity of preparing sufficiently high quantities of homogenous ozone aqueous solutions prior to using these solutions for treating the garments. This can be a complex task because it is common knowledge that ozone can be unstable and very quickly decompose when in water at high concentrations and at ambient or higher temperatures. Therefore, methods which are based on the preparation and use of aqueous ozone solutions can be considered as being impractical and excessively complex and not very cost-effective nor so easily scalable for industrial use. These observations can also be made for example for JPH03146094A which mentions the use of pre-prepared aqueous ozone solution for treating wool garments. In fact, the method disclosed by JPH03146094A is further characterized by the low quantities of the ozone dissolved within the water, specifically 1-2000 PPM of $O_3$ (ozone) in water, which when assumed to be a concentration by weight, it corresponds to an ozone concentration of 1-2000 g $O_3$ per cubic meter of water. If the medium containing the ozone was different, for example if it was air instead of water, then due to the different specific weights of air and water, the aforementioned 1-2000 PPM ozone concentration by weight would correspond to about 0.0017-3.51 g $O_3$ per cubic meter of air, which can be considered as being a low ozone concentration. It is doubtful that very low concentrations of ozone can be used for the rapid treatment of garments as is required by the industry. Moreover, JPH03146094A describes the need for using a detergent dissolved within the aqueous solution of ozone, and this adds to the complexity of the therein disclosed method.

In contrast to the aforementioned prior-art documents, NZ521591A and the non-patent document by Thorsen (W. J. Thorsen, "New aspects on the Ozonization of Wool", Textile Research Journal, 1965, vol 35, pages 638-647) describe processing of wool by ozone gas and not by ozone aqueous solutions, but these documents can be considered as of little relevance to the large scale industrial processing of wool garments for many reasons, such as the following ones. The document by Thorsen reports a very small scale experimental setup related to the ozone treatment of a single textile piece, and the method and apparatus mentioned therein is completely unsuitable for application on a batch of several garments as is required by the industry. NZ521591A describes the treatment of fibrous mass and not the treatment of garments. For this reason, the method described in NZ521591A for processing wool mass would not be applicable for processing wool garments. For example, NZ521591A specifies that the method disclosed therein is applied on a fiber mass web of constant width and length, and a characterizing part of the method is that said mass is moving across a conveyor belt while ozone gas streams are injected on both sides of the web as to force the ozone gas to be constantly passing through the fiber mass web. This method is very complex and obviously not compatible with garments which generally do not have a constant width and thickness nor can be arranged as a web. Moreover, for a cost effective and fast processing of wool garments it is best to avoid the extensive use of large space and high energy consuming conveyers and similar complicated structures. Instead, there is a great need for new processing methods that work when then garments to be treated are concentrated in small spaces such as in a single rotative tumbler. As mentioned further above, the felting and shrinkage of wool garments is at least partially related to the mechanical forces applied to them during to the processing of the garments, and is also related to the friction forces in between the textiles of the garments. Therefore, the problem of how to control and inhibit the feting and shrinkage of wool garments by fast, environmentally friendly, industrially relevant, and cost effective ozone treatments that require small spaces and simple apparatuses that contain several garments at high concentrations, while at the same time avoiding damaging the garments by the treatment itself, is a problem that can only be solved by exercising inventive activity as is the case for the herein presented invention.

SUMMARY

The invention in its first aspect is a method for the processing of wool garments for controlling and inhibiting their subsequent felting and shrinkage. Herein, the term "wool garments" is to be understood as meaning the garments comprising any kind of wool fibers, or the garments comprising any kind of blends and combinations of any kind of wool fibers with any kind of other fiber materials used for making garments. This meaning includes the cases where the fabric of the garment comprises comb wool or coarse wool or any other kind of wool including cashmere or mohair or any kind of animal fiber yarn or any wool blended with other non-wool fibers.

Hence, the invention in its first aspect is a method for the treatment of wool garments with ozone gas to control and inhibit their felting and shrinkage during their subsequent industrial finishing process and/or domestic washing care, which method comprises the steps of:

- wetting the garments; and
- treating the garments inside the interior of a rotative tumbler for a time period of between and 60 minutes at ambient temperature with ozone gas, said ozone gas being at a concentration in air of between 20 g ozone/$Nm^3$ and 150 g ozone/$Nm^3$, wherein the rotative tumbler which contains the garments is rotated at a speed of between 10 rounds/min and 25 rounds/min.

The inventor discovered that the aforementioned method works very well as an anti-felting and anti-shrinkage treatment for wool garments at an industrial scale and with the added benefits of being environmentally friendly, fast and facile in its implementation. While some suboptimum anti-shrinkage or anti-felting effects can be achieved when other numeric parameters than the ones specified above are used, the specified parameters and features of the method when combined together offer the ability to treat large quantities of garments quickly, uniformly, effectively and with minimal consumption of energy. The steps and features of the method and their importance are described and analyzed in more detail.

The first step of the method, that is the step of wetting the garments, is an essential step without which the subsequent treatment with ozone gas will not be efficient or fast enough or will not result to uniform anti-shrinkage effects on all the garments contained within the rotative tumbler. In the context of this invention, wetting the garments is to be understood as any kind of usual garment processing which results to having garments wetted with wetting solvents such as water or/and with other industrially relevant garment wetting solvents such as ethanol. Non-limiting examples of such processes are:

- washing the garments with solutions comprising any of said wetting solvents and detergents and/or softeners;
- rinsing the garments with water and/or solutions or liquids comprising water and/or other wetting solvents;
- exposing the garments to vapors of said wetting solvents;
- partially drying wet garments with techniques such as warming them up or exposing them to hot or cool air which cause the partial evaporation of the water and/or of the any other wetting solvents from the surface and from the interior of the garments;
- partially extracting the wetting solvents from the wet garments with techniques such as pressing/squeezing the wet garments or centrifuging them; and,
- applying any combination of any of the above.

The inventor found that in a preferable and optional variation of the method, the first step of the method is wetting the garments with water. Also, they found that in another optional yet more preferable variation of the method, the garments are wetted to a final water to garment concentration by weight of between 10% and 120%, and this means that the first step of the method is wetting the garments with water to a final water to garment concentration by weight of between 10% and 120%. In an even more preferable and optional variation of the method, the garments are wetted to a final water to garment concentration by weight of between 40% and 70%. This last variation of the method was found by the inventor to work exceptionally well, for example, if the water concentration by weight is not as specified above, i.e. if there is absence of water or if the water concentration is too low or too high, then treating the garments with ozone over a period of up to 60 minutes will not suffice for offering a good and uniform anti-shrinkage effect. Another adverse effect of not having the specified water concentration is that the ozone gas treatment will damage the garments, meaning that damages may be inflicted on the garment's wool fibers, or other type of damages will happen such as an undesired and uncontrolled discoloration of the garments. The wetting of the garment at the specified water to garment concentration by weight can be achieved by different ways. In one example, the final water to garment concentration by weight of between 40% and 70% is achieved by wetting the garments with excess water and then extracting excess water from the wetted garments. This means wetting the garments at a water concentration of more than 70%, and then removing the excess water by partially drying or extracting it until the water concentration of the garments by weight is of between 40% and 70%, i.e. until there is about 40 kg to 70 kg of water for every 100 kg of wool garments. It is thus obvious that the final water to garment concentration by weight is defined as (weight of the water absorbed on the garments)/(weight of the garments when dry)*100(%), wherein both of the aforementioned weights are measured in same weight units. The drying or extracting of the garments can for example be done by pressing the wet garments for squeezing out their excess water content, or by spinning or centrifuging the garments for extracting their excess water content. Of course, the wetting of the garments at the specified water concentration, can also be achieved by measuring the weight of the originally dry garments and then wetting them and mixing them with the appropriate amount of water which when absorbed completely then the wet garments have the specified water to garment concentration by weight. The inventor also found that the method works exceptionally well, when the garments are wetted to a final water to garment concentration by weight of between 61% and 70%, in which case the felting and shrinking of the garments can be almost completely prevented by the application of the method. It is noted that the aforementioned ranges for the water to garment concentration by weight, are very easy to practically achieve during the industrial implementation of the method using industrial machines or machines intended for domestic use. Non-limiting examples of such machines are washing and/or drier machines or other equipment for garment processing. Two more specific non-limiting examples of such machines, are the EH255 commercial washer by Continental Girbau Inc., and the ATOLL commercial washing machine from STAHL Laundry Machines (STAHL Waschereimaschinenbau GmbH).

The second step of the method, that is the step of treating the garments inside the interior of a rotative tumbler for a time period of between 15 and 60 minutes at ambient temperature with ozone gas, said ozone gas being at a concentration in air of between 20 g ozone/$Nm^3$ and 150 g ozone/$Nm^3$, wherein the rotative tumbler which contains the garments is rotated at a speed of between 10 rounds/min and 25 rounds/min, comprises several important features. The first feature is the rotative tumbler inside which the wet garments are placed and the ozone gas treatment of the garments takes place. The tumbler offers the additional functionalities of shaking and moving the wet garments and keeping their water content uniformly distributed and constantly mixing them with the ozone gas containing atmosphere inside the tumbler during the ozone treatment. Therefore, the second feature of the invention is that the rotative tumbler which contains the garments is rotated at a speed of between 10 rounds/min (rounds per minute) and 25 rounds/min. At this speed, the inventor has found that the method works surprisingly and unexpectedly well. While some anti-felting and anti-shrinkage effect can be achieved if the rotating speed is not the specified above, the inventor has found that when a speed of less than 10 rounds per minute is used, this results in obtaining an uneven treatment of the surface and interior of the textile of the garments and also results in the overtreatment of some of the garments inside the tumbler or the overtreatment of some parts of the garments. The overtreatment of a garment or parts of it produces adverse effects such as the damage of the wool fabrics or an unwanted or uncontrolled discoloration of the garment. As also discovered by the inventor, similar adverse effects are produced when the rotative speed is more than 25 rounds/min, in which case shrinkage of the garments is not sufficiently prevented. The inventor contemplates that any adverse effects generated by high rotation speeds are associated with the increased mechanical stress being applied to the garments, and/or with the possibility that the garments are excessively compacted together, and/or with the possibility that the garments stick firmly to the walls of the tumbler as a result of the high centrifugal force acting on them.

Regarding the rotative tumbler, it must also be noted that in the present invention, this tumbler can optionally be sealed for the duration of the treatment of the garments with ozone gas. In this case, the term "sealed" is to be understood as meaning that no ozone is leaking from the tumbler to the ambient atmosphere, because ozone can be toxic at high concentrations. Nevertheless, during the treatment of the garments, the sealed tumbler can be receiving ozone gas from an ozone gas supply connected to it, and also the ozone gas can be exiting the tumbler towards any ozone gas destruction unit connected to the tumbler, such as an ozone burner which decomposes the ozone before releasing non-toxic gas to the atmosphere.

The third important feature of the method is that the time duration of the treatment with ozone gas is of between 15 minutes and 60 minutes. Some anti-shrinkage and anti-felting effects are obtained if the time duration is not the one specified above. Nevertheless, the specified time window works unexpectedly well for obtaining good results from the method. Furthermore, when treating the garments for more than 60 minutes while all the other parameters of the method are the ones specified in it, then the inventor found that adverse effects such as the ones mentioned above in relation to suboptimum rotation speeds of the tumbler, also appear.

Similarly, the inventor found that If the ozone gas treatment is applied for less than 15 minutes, then the anti-shrinkage and anti-felting effect obtained by the method is minimal and/or insufficient and/or uneven across the different garments inside the tumbler, and as a result the garments potentially shrink and felt during any subsequent industrial finishing processes and domestic washing care applied on them.

The fourth important feature of the method is the temperature at which the ozone gas treatment takes place, and that temperature is ambient temperature. This offers the tremendous advantage of not having to consume energy for changing the temperature at which the process takes place, for example of not having to heat or cool the water used, and/or the garments, and/or the tumbler, and/or the ozone gas. As a result, the method is environmentally friendly and cost effective since the consumption of energy for cooling or heating processes would entail a financial cost and the consumption of natural resources. The ambient temperature varies depending on the region and/or the establishment at which the method takes place, and also varies depending on the climatic conditions in the region and/or in the establishment. The inventor found that the method of the invention works surprisingly well when the temperature is an ambient temperature. It is to be understood by the term "ambient temperature", a temperature between 5° C. and 40° C., which coincides with the temperature of most industrial establishments in which garment processing takes place. Moreover, this ambient temperature range combines well with the other features of the method for achieving a good control and inhibiting the shrinkage and felting and of the garments during their subsequent processing. If however, the temperature is less that 5° C. then the inventor has found that the ozone gas treatment does not effectively prevent felting and shrinkage during the subsequent treatment of the garment. Also, if the temperature is more than 40° C. then undesired effects such as discoloration of the garments and damage of their wool fibers take place and accompany any suboptimum anti-shrinkage effects obtained by the ozone treatment.

The fifth important feature of the second step of the invention is the ozone gas at a concentration in air of between 20 g ozone/$Nm^3$ and 150 g ozone/$Nm^3$. The term "air" is to be understood as the gas atmosphere containing the ozone gas, and said gas atmosphere may have various possible compositions. Apart from the ozone contained in it, this gas atmosphere may be normal atmospheric air, or may be atmospheric air having higher or lower than normal oxygen and/or humidity contents, or may be an inert gas atmosphere comprising an inert gas such as nitrogen or argon, or mixtures thereof. In all of the aforementioned possible cases, it is important that the ozone gas concentration in air is the one specified above because if the ozone gas concentration is different, then the effects of the method will be suboptimum and/or will be accompanied by detrimental effects. If for example the ozone gas concentration is less than 20 grams of ozone per standard cubic meters of air (g ozone/Nm3) then the effect of the method will be very small and will not suffice for inhibiting the felting and shrinkage of the garments during their subsequent processing. This could potentially be avoided by increasing the duration of the ozone gas treatment to being more than 60 minutes, but such a variation would be of small industrial applicability due to the large duration of the method. If however, the ozone gas concentration is more than 150 g/$Nm^3$ then adverse effects such as uncontrolled and excessive discoloration of the garments or parts of them will also happen. If however, the ozone gas is at a concentration in air of between 20 g ozone/$Nm^3$ and 150 g ozone/$Nm^3$ then there is a very pronounced and optimum inhibition or prevention of the felting and shrinkage of the garments during their subsequent processing.

It is important to mention that since the method of this invention concerns the treatment of the garments with ozone gas in air, said ozone gas is not provided to the interior of the tumbler that contains the garments in the form of a gas-liquid solution. For this reason, the ozone gas preferably enters the tumbler through at least one point of the latter which is located above the garments and above any water or liquid solvent that may be released by the wet garments during their processing inside the tumbler.

The second step of the invention can in practice be implemented using either the same or a different machine than the machine or machines used for the first step of the method. In one non-limiting example, the method is implemented by executing its first step in one machine, and implementing its second step in a second machine. Non-limiting examples of such second machine, are the various models of the commercially available Jeanologia G2 machine family, such as the G2 Cube, the G2 E and the G2 Lab. Each of these machines comprises a rotative tumbler which is enclosed within a chamber, and the rotative tumbler, meaning the interior of it, is connected to and can receive ozone gas from an ozone generator which takes air and convert it to an ozone containing gas of an adequate ozone concentration in air. A type of an ozone generator that works very well for implementing the present invention is a generator that produces from 50 to 2500 g (grams) of ozone gas per hour. The rotative tumbler is further connected to a unit which can receive ozone from the interior of the tumbler and decompose or destroy said ozone gas and release non-toxic air to the atmosphere. In the aforementioned examples of machines, the rotative tumbler can be accessed for inserting the garments inside it before treating them with ozone, and for extracting the garments from it after their treatment with ozone, through a door located on the chamber and in front of the tumbler's opening. The chamber that encloses the tumbler and the closing door located thereon contribute towards sealing the tumbler during the ozone treatment of the garments, so that the user of the machine is not exposed to the ozone gas with which the garments are processed. It must be noted that the working parameters applied during the use of commercially available machines. such as the machines mentioned above, for implementing the second step of the method and its variations, must be chosen and adjusted by the user according to the teachings of the present invention. For example, the rotation speed of the tumbler and the ozone gas concentration must be adjusted according to the teachings of the present invention. Similarly, if any minor and obvious technical modifications must be made on any commercially available machines for implementing the method, these modifications can be made considering the teachings of the present invention. An example of such obvious modification is connecting a rotative tumbler machine for garment processing, to an ozone generator and to an ozone destruction unit, or incorporating the latter two components inside a machine that comprises a rotative tumbler.

As described above, the method of the invention is a method of great applicability in the garment industry. Therefore, it is important that the method works well when applied to batches containing several garments. For this reason, the inventor has found that optionally the weight of all garments placed within the rotative tumbler of a particular volume, is chosen as to further improve the anti-shrinkage and anti-felting effect offered by the method of the invention, and as to further avoid any detrimental effects from the application of the method on the garments. For the same reasons, the volume of the interior of the rotative tumbler inside which garments of a specific total weight are placed, may be chosen according to the total weight of the garments. For the above reasons, optionally in the aforementioned method for the treatment of wool garments with ozone gas to control and inhibit their felting and shrinkage during their subsequent industrial finishing process and/or domestic washing care, the ratio of the rotative tumbler interior volume to garments weight is between 0.01 $m^3$/kg and 1 $m^3$/Kg. When the aforementioned ratio is chosen as to be within the aforementioned value range, then the anti-shrinkage and anti-felting effect offered by the method is exceptional and any detrimental effects are avoided. On the contrary, if the ratio is smaller than 0.01 cubic meters per kilogram ($m^3$/Kg), where cubic meters refers to the volume of the interior of the rotative tumbler and kilogram refers to the weight of the garments placed within said interior, then there is a chance that undesired effects such as discoloration or damage of the fabric of the garments will accompany any anti-shrinkage effect. It is also preferable that the aforementioned ratio is not larger than 1 $m^3$/Kg, because in the opposite case the method is not as effective in preventing the shrinkage and felting of the garments. For similar reasons, it is further preferable if the aforementioned ratio is between 0.05 $m^3$/Kg and 0.5 $m^3$/Kg.

There are additional optional steps and associated features which are also part of the same inventive concept of the invention. Therefore, the method of the invention may additionally and optionally comprise rinsing the garments with water. Rinsing the garments with water is to be applied after the treatment of the garments with ozone. The step of rinsing with water serves the purpose of physically removing any ozone that potentially remains on the surface and within the fibers of the garments, and/or serves the purpose of accelerating the decomposition of said remaining ozone. The step of rinsing with water also serves the purpose of removing any potential chemical byproducts of the interaction of the ozone with any of the contents of the tumbler, as long as said byproducts can be washed away with water. Although it is expected that there does not remain any substantial quantity of ozone and/or chemical byproducts on the garments after the second step of the method, the inventor found that the rinsing of the garments with water can in practice ensure that the garments will not contain ozone or chemical byproducts after the application of the full method. In a more preferred case, the temperature of the water used for rinsing the garments is between 5° C. and 95° C. Also, optionally said temperature is between 60° C. and 90° C., or is between 5° C. and 20° C. Nevertheless, most preferably the temperature of the water used for rinsing the garments is between 30° C. and 40° C., because the inventor found that if the water temperature at this step is less than 40° C. and is more than 30° C. then the anti-shrinkage and anti-felting effects of the method are very good.

While the aforementioned method and its variations are very effective in solving the technical problem that this invention relates to, the inventor has found that even better results can be obtained when optionally the method further comprises a treatment of the garments with at least one enzyme. In that case, the afore-described method further comprises the following steps:

wetting the garments with a mixture comprising water and at least one enzyme;

waiting for a time period for said at least one enzyme to act on the surface of the garments; and stopping the action of the at least one enzyme.

The aforementioned complementary treatment of the garments with at least one enzyme pertains to the same general inventive concept as the rest of the method, because the ozone treatment and the enzyme treatment have a synergistic anti-shrinkage and anti-felting effect. Specifically, while it is known in the prior art that the treatment of wool with some enzymes may have an anti-shrinkage effect on the wool, the inventor found that unexpectedly the combination of treating the garments with ozone gas and treating the garments with at least one enzyme produces a synergistic anti-felting and anti-shrinkage effect which is superior compared to the effect obtained when treating the garments only with ozone gas or when treating the garments only with at least one enzyme. Moreover, for obtaining an anti-shrinkage and anti-felting effect at a specific level, a smaller ozone gas concentration and/or a shorter duration of gas treatment is required when the ozone gas treatment is followed by the enzyme treatment. Similarly, a smaller amount of the at least one enzyme is required for achieving an anti-shrinkage and anti-felting effect at a specific level, when the enzyme treatment is preceded by the ozone gas treatment. Overall, the combination of the ozone gas treatment and the enzyme treatment offers the advantage of reducing the required amounts and thus concentrations of ozone and of enzymes, and also reducing the durations of the respective ozone and enzyme treatment steps, for achieving very good anti-shrinkage and anti-felting effects on the garments. Therefore, the enzyme treatment should be understood as something that enhances the anti-shrinkage and anti-felting effect of the ozone gas treatment, and that improves the overall method.

As described further above, the aforementioned treatment of the garments with the at least one enzyme follows the treatment with the ozone gas, and starts with wetting the garments with a mixture comprising water and at least one enzyme. This mixture can for example be made by dispersing and/or dissolving the at least one enzyme within an amount of water, or by having the at least one enzyme at an at least one location and then adding water at that at least one location or passing water through that at least one location so the enzyme is dissolved by the added water and/or is carried through by the water when the latter is passing. When the mixture is made as described above, it is then added to the garments for wetting them with it. Alternatively, the wetting of the garments with the mixture can be done by first adding the at least one enzyme to the garments and then also adding the water, or by first adding the water to the garments and then also adding the at least one enzyme.

The weight of the at least one enzyme that is optionally used in the method can optionally be chosen according to the total weight of the wool garments being processed by the method. Therefore, the at least one enzyme to garments concentration by weight, which is the ratio derived by dividing the weight of the at least one enzyme measured in kilograms over the weight of the wool garments measured in kilograms, can optionally be chosen as to further optimize the anti-shrinkage and anti-felting effect of the method and avoid the appearance of any other undesired effects. Therefore, in the optional case that the method comprises a treatment of the garments with at least one enzyme, then optionally the at least one enzyme to garments concentration by weight is between 0.01% and 20%. It is more preferable that the at least one enzyme to garments concentration by weight is between 0.01% and 10%. If the enzyme to garments concentration by weight is smaller than 0.01%, which means that there is less than 0.01 Kg of enzyme for every 100 Kg of garments, then the enzyme treatment may not have a significant contribution to the beneficial effects offered by the method. If the enzyme to garments concentration by weight is larger than 10% then the enzyme treatment may be excessive and damage the fabric of the wool garments. For similar reasons, it is further preferable that the at least one enzyme to garments concentration by weight is between 0.1% and 3%. From the above it is further obvious that the at least one enzyme to garments concentration by weight is defined as (weight of the at least one enzyme)/(weight of the wool garments)*100(%), wherein both of the aforementioned weights are measured in same weight units.

The enzyme or enzymes that is/are used for enzyme treatment during the method can be any kind of enzyme used for treating wool, but preferably the enzyme is an enzyme that helps proteolysis, therefore preferably the enzyme is a protease. Therefore, a preferable variation of the method is the one wherein the at least one enzyme is a protease. This is because proteases work very well with the method as to obtain the herein described synergistic effect of the ozone gas treatment and the enzyme treatment. In a non-limiting example, the protease used for treating the garments is a subtilisin which can for example be provided in the form of the commercial product Savinase® of Novozymes® A/S.

When the garments are treated with the enzyme, after wetting the garments with a mixture comprising water and at least one enzyme, then the method further comprises waiting for a time period for said at least one enzyme to act on the surface of the garments. Optionally and preferably the time period for said at least one enzyme to act on the surface of the garments is between 1 minute and 60 minutes. This is a preferable option because enzyme treatments which last less than 1 minute will not yield a significant anti-shrinkage effect in combination to the other steps and features of the method. In addition, enzyme treatments which last more than 60 minutes will result in damaging or destructing the wool fibers of the garments due to an overtreatment of the fibers by the enzyme. In fact, it is further preferable that the time period for said at least one enzyme to act on the surface of the garments is between 6 minute and 60 minutes. This is because the inventor found that occasionally and depending on all other parameters and features of the method, 5 minutes or less for enzyme treatment may not be a time long enough for inhibiting the shrinkage and felting of the garments during their subsequent treatment.

The temperature of the mixture used for the optional enzyme treatment, said mixture comprising water and at least one enzyme, can optionally be controlled for further optimizing the desired effects of the method and for shortening the duration of the ozone gas treatment and/or of the enzyme treatment. For this reason, preferably in the optional case of wetting the garments with a mixture comprising water and at least one enzyme, the temperature of the mixture is between 5° C. and 80° C., and more preferably the temperature of the mixture is between 5° C. and 53° C. When the temperature is higher than 53° C. then there is a non-negligible possibility that the enzyme treatment may damage the wool fabrics of the garments. When the garments are treated with the enzyme, after waiting for a time period for said at least one enzyme to act on the surface of the garments, then the method comprises the step of stopping the action of the at least one enzyme. This additional step is applied in order to stop the action of the at least one enzyme to the garments, because if it is not stopped it may continue acting on the wool fibers and damage them. Stopping the action of the at least one enzyme can for example be done by rinsing the garments with water for washing away the at least one enzyme from the garments, and/or by heating the garments and/or by heating the mixture comprising water and at least one enzyme to a temperature of between 30° C. to 95° C. for inactivating the enzymes.

Since it is known from the prior-art that felting and shrinkage of wool garments often happens during and as a result of the various processes used for dyeing the garments, it is of particular interest that the method presented herein inhibits and controls the shrinkage and felting of the garments during their dyeing when such dyeing is applied. Unexpectedly, the inventor found that the method described herein not only offers the aforementioned useful effects and advantages, but also results to increasing the efficiency of the dyeing process. Specifically, the inventor found that in relation to the dyeing of the garments, the method of the invention controls and inhibits the shrinkage and felting, and at the same time increases the dye uptake of the garments, when the dyeing of the garments is incorporated in the method as a last step of the method. Therefore, an optional variation of the method is a method according to any of the above variations, further comprising dyeing the garments In this optional variation of the method, dyeing the garments must be understood as meaning any of the processes that are commonly used in the wool garment industry for dyeing the garments and/or dyeing parts of each garment. Such processes can entail washing or softening the garments after their coloration by the dyes applied to them.

The method and its variations presented here can include further optional and commonly encountered in the garment industry and household practice steps and processes such as drying the garments, washing the garments, dyeing the garments, treating the garments with substances such as softeners and deodorizers, just to mention a few. Such additional steps can indeed be applied following the method of this invention, because the method inhibits and prevents the felting and shrinkage of the garments during the application of these steps. Therefore, any additional steps of this nature, are believed by the inventor to be obvious to the common practitioner, and will not be described here in more detail. It is however noted, that the method of the invention and its variations, can be applied successfully on any type of wool garments. Therefore, a variation of the method is the method according any of the aforementioned, wherein the fabric of the garment comprises comb wool or coarse wool or any other kind of wool including cashmere or mohair or any kind of animal fiber yarn or any wool blended with other non-wool fibers.

The invention in its second aspect concerns a wool garment treated with the method of the first aspect of the invention or any variations of said method that may include any of the herein described optional features and steps of the method. The wool garment of the second aspect of the invention may also have one or more of a variety of optional features that individually or in combination between them can be used for distinguishing and identifying the wool garment. Consequently, said features of the wool garment can only be considered as optional ones, with the only essential one being that the garment has being processed with the method of the invention and as such exhibits the most important property conveyed by the method, said property being that the shrinkage and/or felting of the garment during the latter's subsequent industrial finishing process and/or domestic washing care following the application of the method, are being controlled and/or inhibited. Nevertheless, considering that in the technical field of the invention it is particularly useful to identify the wool garments' optional features which stem from the application of the method and as such can be used for the complementary identification of the wool garments that have being treated with the method, the optional features of the second aspect of the invention are presented below.

Firstly, optionally and preferably, the wool garment comprises wool fibers, each of said wool fibers having a body which, as a consequence of the treatment of the wool garment with the method, is either stripped of scales, or it comprises scales wherein each of said scales is attached onto a surface of the body fitting and following the contour of the latter and has edges that are also attached to the surface of the body fitting the contour of the body and not standing out with respect the surface of the scale. Optionally, all of the edges of said each scale do not stand out with respect the surface of the scale. The aforementioned features can for example be identified using imaging of the fibers via scanning electron microscopy (SEM), and can be considered as a consequence of the optimum application of the method on the wool garment, because the application of the method may result to the smoothening and/or partial or complete elimination of the scales. It is noted that SEM inspection of wool fibers of a wool garment not treated by the method of the present invention may reveal that the fibers have scales which appear as being partially detached and standing out from the body of the fiber and/or that said scales have edges that stand out from the rest of the surface of the corresponding scale. Therefore, when these scales are being smoothened and/or partially eliminated due to the optimized application of the invention's method, the fiber when examined with SEM appears to be very smooth having scales which are well attached to the body. Without wishing to be bound to any specific theory, the inventors believe that the change of the fiber's surface morphology may stem from the fact that ozone is a strong oxidant which in combination with the method's other specific parameters affects the fiber's surface chemistry which in turn is associated with the morphology of the fiber. The smoothening of the fiber when it happens can in turn be considered as being associated with the garment's resistance to felting and shrinkage, because either of these undesired effects is promoted by the increased rubbing and interlinking of the scales when the edges of said scales are not firmly attached to the surface of the fiber's body. For the same reason, in the wool garment of the second aspect of the invention, optionally and preferably, the scales being attached onto the surface of the body and have edges that are also attached to the body not standing out, account for more than 50%, and preferably more than 80%, of all the scales of the body; in this case the resulting overall smoothness of the wool fibers at the microscale render the wool garment even less prone to felting and shrinkage. It is worth noting that there are known a variety of different scanning electron microscopy techniques that can be used for viewing and inspecting the fibers of the wool garments and surface morphology of a fiber, and of the body and scales of the fiber; a non-limiting list of examples of said techniques are secondary electron-SEM and backscattered electron-SEM. The scanning electron microscope that can be used for imaging the wool fibers can optionally be configured to any of the following settings:

Magnification of between 800 and 1500 times,
accelerating voltage: 5 kV,
working distance: 12 mm.

Moreover, the wool fibers prior to being studied with the scanning electron microscope may be covered with a very thin layer of Au—Pd evaporated on them for rendering them conductive as is commonly known in the standard practice related to SEM imaging of samples.

Regarding the wool garment of the second aspect of the invention there is also contemplated the optional and preferable case wherein the area of the surface of the garment changes by less than 10%, and preferably by less than 5%, when the garment is subsequently laundered. The shrinkage percentage can be calculated based on measurements of the garment or of a part of the garment's fabric in the width and length directions before washing, and doing the same measurements after washing. The expert will immediately understand that the specific numerical parameters mentioned in the present paragraph can be considered as being the consequence of having a wool garment that has been processed by an optimum and preferred variation of the method of the invention. It is worth noting that there may be various different ways for laundering the garment for determining that the garment has indeed the feature described in this paragraph. A non-limiting list of examples of different laundering processes are described below:

Laundry method 1: Using a regular domestic washing machine, selecting cotton program and setting up the temperature to 60° C.

Laundry method 2: Doing a wash in a rotatory industrial sampling washing machine, being the nominal load of the rotatory sampling machine between 5 kg and 20 kg. The washing for shrinkage and verification being done in 4 different steps detailed bellow:

Step 1: Washing at 60° C.
Liquor ration (volume of water measured in liters per kilograms (kg) of garments being tested): 1:10
Speed rotation: 25 rounds per minute (rpm)
Rotation direction: Right and left
Process temperature: 60° C.
Processing time: 30 min Step 2: Cold Rinse
Liquor ration (volume of water measured in liters per kilograms (kg) of garments being tested) 1:20
Speed rotation: 25 rpm
Rotation direction: Right and left
Process temperature: 20° C.-30° C.
Processing time: 3 min Step 3: Spinning Step 4: Tumbler Drying.

Regarding the wool garment of the second aspect of the invention there is also contemplated the optional and preferable case wherein the wool garment meets the requirements for being categorized as machine washable wool according to test TM31 regarding dimensional stability of wool garments. The TM31 test is a test defined by ©The Woolmark Company; the TM31 test method is based on ISO 6330 and measures shrinkage and fabric appearance after laundry, and is known in the prior art. Dimensional stability of a fabric refers to the change of the fabric size when the fabric is used or reprocessed. Dimensional stability is related to fabric's properties and the conditions of use and/or processing of the fabric, and can be defined as the percentage change in either the length or width of the garment or the garment's fabric when the garment or fabric is processed, e.g. when the fabric or garment is laundered and/or dried. If the width and/or the length of the garment or of the garment's fabric change/s, then consequently the area of the surface of the garment/fabric may change accordingly.

DETAILED DESCRIPTION

In the first and preferred embodiment of the first aspect of the invention, the method for the treatment of wool garments with ozone gas to control and inhibit their felting and shrinkage during their subsequent industrial finishing process and/or domestic washing care, comprises the steps of:

wetting the garments; and treating the garments inside the interior of a rotative tumbler for a time period of between 15 and 60 minutes at ambient temperature with ozone gas, said ozone gas being at a concentration in air of between 20 g ozone/$Nm^3$ and 150 g ozone/$Nm^3$, wherein the rotative tumbler which contains the garments is rotated at a speed of between 10 rounds/min and 25 rounds/min.

Figure 1:
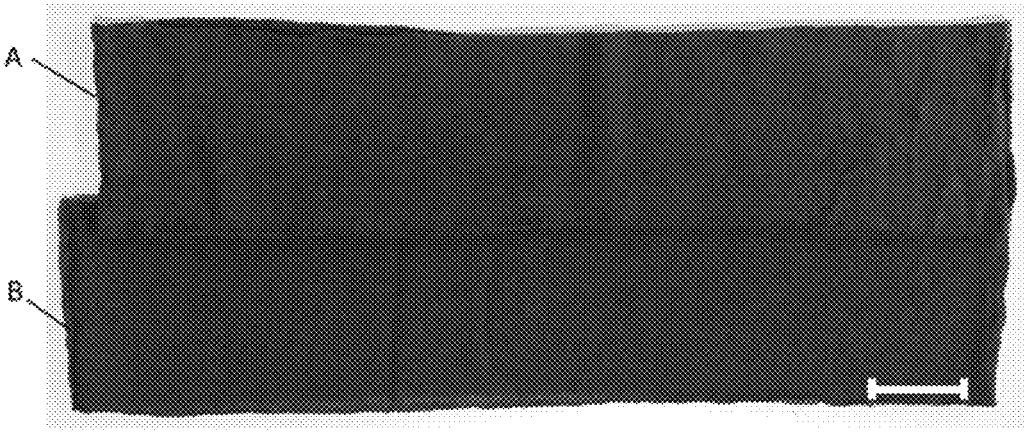
FIG. 1 is a photograph of two washed wool textile samples, wherein prior to washing one sample was treated according an embodiment of the method of the invention and the other sample was not. The shown scale bar at the bottom right of the photograph, corresponds to 5 cm length.

In the aforementioned first embodiment, the speed of rotation of the rotative tumbler is a particularly important parameter which has to be within the indicated above range, otherwise the method will not work effectively. If the speed is higher than 25 round/min then the method does not work well and the garments shrink during their subsequent washing. This is shown in FIG. 1 which shows a wool sample B which was first treated according to the first embodiment of the method and for which the speed of tumbler was 10 rounds/min, and after the application of the method the sample was washed. FIG. 1 also shows a wool sample A (of same material and original dimensions as sample B) which was processed in the same manner as sample B but with the difference that the speed of the tumbler was 28 rounds/minute. Therefore, it is evident from FIG. 1 that sample A shrunk in length compared to sample B.

Figure 2:
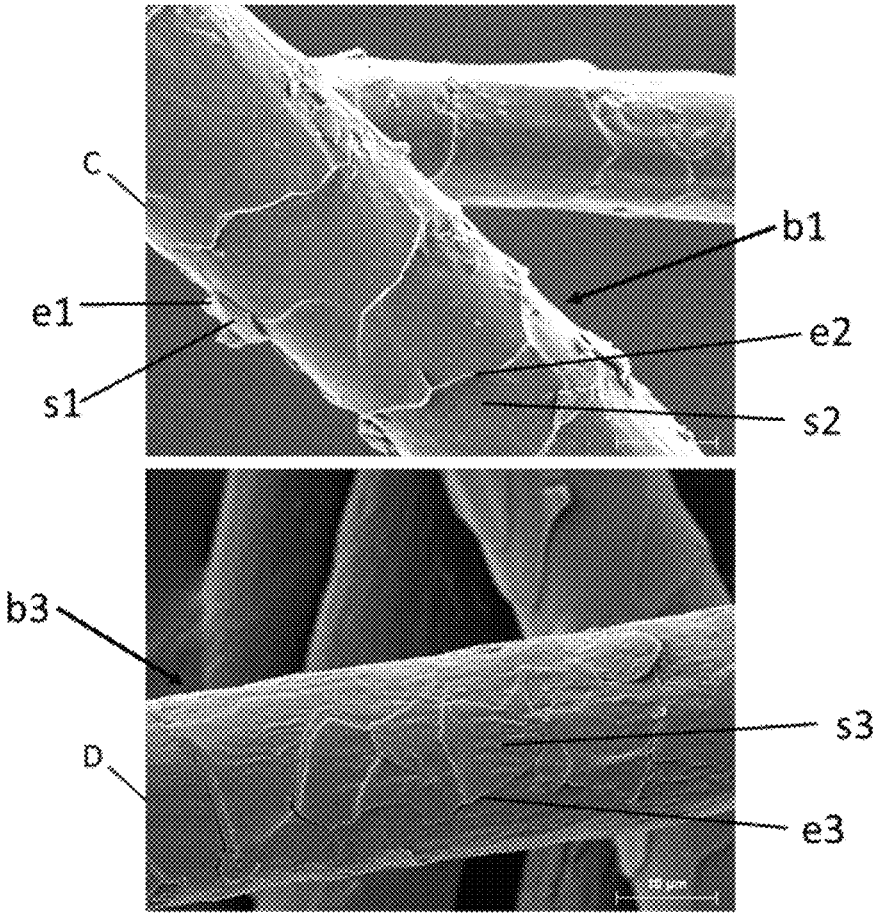
FIG. 2 is two scanning electron microscope (SEM) images of the wool fibers of a textile sample, before and after treating the sample according to an embodiment of the method of the invention. The scale bar of each image of FIG. 2 corresponds to 10 micrometers.

All parameters indicated in the first embodiment of the method are important for achieving the good anti-felting and anti-shrinkage effect offered by the method. It was observed by the inventor that the application of the method and the achieved inhibition and control of the shrinkage and felting of the garments during their subsequent processing, are accompanied by a change of the micromorphology of the wool fibers of the textile of the garments. This change is shown in FIG. 2 which shows images taken using scanning electron microscopy (SEM). Image C of FIG. 2 shows the wool fibers of a sample before its processing according to the first embodiment of the method, and image D shows the wool fibers after the processing of the sample according to the first embodiment of the method. In image D the scales (cuticle) of the wool fiber appear more firmly attached to the body of the fiber, compared to the fiber shown in image C. In the aforementioned, "being firmly attached" may mean that each of said scales being firmly attached, is attached onto a surface of the body fitting and following the contour of the latter and has edges that are also attached to the surface of the body fitting the contour of the body and not standing out with respect the surface of the scale. In image C of FIG. 2 the body b1 of one of the two fibers shown therein is indicated by the drawn arrow. Moreover, in image C of FIG. 2 scale s1 with its edge e1, and scale s2 with it edge e2 are indicated. As can been seen in image C, both indicated edges e1 and e2 are not attached on the surface of the body b1, and in particular edge e1 visibly and obviously stands out from the surface of body b1 and from the rest of the surface of the scale s1. Likewise, edge e2 stands out from the body b1 and from the rest of the surface of the scale s2. Consequently, for the corresponding scales shown in image C of FIG. 2 it cannot be said that these scales are attached onto the surface of the body fitting and following the contour of the body and have edges that are also attached to the surface of the body fitting the contour of the body and not standing out with respect the surface of the scales. Nevertheless, in image D of FIG. 2 the therein indicated by another black arrow body b3 of one of the two wool fibers seen in the image, comprises the also therein indicated scale s3 which has an edge e3 which is attached on the surface of the body. The edge e3 clearly and obviously does not stand out with respect to the surface of the body and especially with respect to the rest of the surface of the corresponding scale s3. Moreover, it has been observed using SEM mages that another possible consequence of the optimum treatment of the wool garment with the present method is the partial or complete removal of the scales from the surface of the fiber and its body. The images of FIG. 2 were acquired with a ©Hitachi S4100 scanning electron microscope having a field emission gun capable of achieving a resolution of 1.5 nm at 60 kV, and equipped with a back scattered electron detector and system for capturing digital images. For capturing the image, the microscope was operated at 5 kV, and the working distance was 12 mm.

As discussed before, the treatment-induced possible removal of the scales from the surface of the body, or the treatment-induced better and more uniform attachment of the scales and the scales' edges on the body of the wool fiber may originate from the physicochemical changes imparted on the wool fiber by the ozone gas under the specific conditions specified in the method. When the scales and/or edges are removed (partially or completely) or their attachment on the body is improved, then the interlinking (entanglement) and/or enlacement between the scales and/or of the scales' edges, especially between scales and edges of neighboring fibers, during the processing (e.g. laundering) of the wool garment can be mitigated or prevented or inhibited, and consequently the macroscopically observable shrinkage and/or felting associated with said interlinking (entanglement) and/or enlacement is inhibited or prevented i.e. the garment is rendered shrinkage-proof.

The application of the first embodiment renders the garments sufficiently shrinkage-proof so they can be categorized as "machine washable" and/or "total easy care" garments, wherein the terms "machine washable" and "total easy care" refer to the respective categories of wool garments as defined by ©The Woolmark Company. The inventor performed several tests for evaluating the effectiveness and quality of the method and apparatus described herein, an example of such test is the TM31 defined by ©The Wool Mark company. This test measures shrinkage and fabric appearance after repeated home laundry.

A second embodiment of the invention is the method according to the first embodiment, wherein the garments are wetted with water to a final water to garment concentration by weight of between 10% and 120%.

A third embodiment of the invention is the method according to the first embodiment, wherein the garments are wetted with water to a final water to garment concentration by weight of between 40% and 70%.

A fourth embodiment of the invention is the method according to the first embodiment, wherein the garments are wetted with water to a final water to garment concentration by weight of between 61% and 70%.

Another embodiment of the invention is the method according to any of the previous embodiments, wherein wetting of the garments is achieved by wetting the garments with excess water and then extracting some of the excess water from the wetted garments.

Another embodiment of the invention is the method according to any of the previous embodiments, and wherein the ambient temperature is between 5° C. and 40° C.

Another embodiment of the invention is the method according to any of the previous embodiments, and wherein the rotative tumbler which contains the garments is sealed during the treatment of the garments with the ozone gas.

Another embodiment of the invention is the method according to any of the previous embodiments, and wherein the rotative tumbler is connected to an ozone generator that produces from 50 to 2500 g (grams) of ozone gas per hour.

Another embodiment of the method of the invention is the method according to any of the previous embodiments, and wherein the ratio of the rotative tumbler interior volume to garments weight is between 0.01 $m^3$/kg and 1 $m^3$/Kg, and preferably is between 0.05 $m^3$/Kg and 0.5 $m^3$/Kg.

Another embodiment of the method of the invention is the method according to any of the previous embodiments, and wherein the volume of the interior of the rotative tumbler inside which the garments are placed, is between 0.1 $m^3$ (cubic meter) and 10 $m^3$.

Another embodiment of the method of the invention is the method according to any of the previous embodiments, which further comprises the additional step of rinsing the garments with water after treating them with ozone gas. Another embodiment is the one according to the preceding one, and wherein the temperature of the water with which the garments are rinsed is between 5° C. and 20° C.

Another embodiment of the invention is the method according to any of the previous embodiments, further comprising the following steps:

- wetting the garments with a mixture comprising water and at least one enzyme;
- waiting for a time period for said at least one enzyme to act on the surface of the garments; and
- stopping the action of the at least one enzyme.

Another embodiment of the invention is the method according to the preceding embodiment, and wherein the time period for said at least one enzyme to act on the surface of the garments is between 1 minute and 60 minutes, and preferably is between 6 minutes and 60 minutes.

Another embodiment of the invention is the method according to any of the previous embodiments that include the step of wetting the garments with a mixture comprising water and at least one enzyme, and wherein the temperature of the mixture is between 5° C. and 80° C., and more preferably the temperature of the mixture is between 5° C. and 53° C.

Another embodiment of the invention is the method according to any of the previous embodiments that include the step of wetting the garments with a mixture comprising water and at least one enzyme, and wherein the at least one enzyme to garments concentration by weight is between 0.01% and 20%, and preferably is between 0.01% and 10%, and more preferably is between 0.1% and 3%.

Another embodiment of the invention is the method according to any of the previous embodiments that include the step of wetting the garments with a mixture comprising water and at least one enzyme, and wherein the enzyme is a protease.

Another embodiment of the invention is the method according to any of the previous embodiments that include the step of wetting the garments with a mixture comprising water and at least one enzyme, and wherein stopping the action of the at least one enzyme is being done by rinsing the garments with water, and/or by heating the garments and/or the mixture comprising water and at least one enzyme to a temperature between 30° C. to 95° C.

Another embodiment of the invention is the method according to any of the previous embodiments, which further comprises dyeing the garments.

Another embodiment is the method according to the any of the previous embodiments, further comprising any of the following steps and combinations thereof: drying the garments; washing the garments; treating the garments with softeners and/or detergents and/or deodorizers.

Another embodiment is the method according to any of the previous embodiments, and wherein the fabric of the garment comprises comb wool or coarse wool or any other kind of wool including cashmere or mohair or any kind of animal fiber yarn or any wool blended with other non-wool fibers.

In the first and preferred embodiment of the second aspect of the invention, a wool garment is treated with the method according to any of the embodiments of the method of the first aspect of the invention.

A second embodiment of the second aspect of the invention is the wool garment according to the first embodiment, wherein the wool garment comprises wool fibers, each of said wool fibers having a body which, as a consequence of the treatment of the wool garment with the method, is either stripped of scales, or it comprises scales wherein each of said scales is attached onto a surface of the body fitting and following the contour of the latter and has edges that are also attached to the surface of the body fitting the contour of the body and not standing out with respect the surface of the scale.

A third embodiment of the second aspect of the invention is the wool garment according to the second embodiment of the second aspect invention, wherein the scales being attached onto the surface of the body account for more than 50%, and preferably more than 80%, of all the scales of the body.

Another embodiment of the second aspect of the invention is the wool garment according to any of the previous three embodiments of the second aspect invention, wherein the area of the surface of the garment changes by less than 10%, and preferably by less than 5%, when the garment is subsequently laundered.

Another embodiment of the second aspect of the invention is the wool garment according to any of the previous embodiments of the second aspect invention, and wherein the wool garment meets the requirements for being categorized as machine washable according to test TM31 regarding dimensional stability of wool garments. Machine washable can be interpreted as being the garments for which a "machine wash" care claim can be made according to the TM31 test method (as for example described in page 6 of 8 of the SPECIFICATION SF-1: 2016 published electronically in the following URL: https://www.woolmark.com/globalassets/05-certification/product-specifications/sf-1_knitted_fabric_2016-1_2nov14_f.pdf).

The TM31 test method is known in the prior at (published for example as: WOOLMARK TEST METHOD WASHING OF WOOL TEXTILE PRODUCTS, May 2000, pages 1-19.)

In the following, some specific example of experiments carried out by the inventor for implementing the method of the invention, are described in detail:

Example 1

5 kg of wool garments were wetted with water to a final water to garment concentration by weight of about 62% and then placed in the interior of the rotative tumbler of an interior volume of approximately 3 $m^3$ of a Jeanologia G2 E machine. This machine is designed as to not leak ozone gas to the environment during the processing of garments with ozone. The machine was operated in a specific mode so that the ozone is supplied into the tumbler in the form of gas and not in the form of gas-water solution. It was checked that when the tumbler is sealed, the ozone passed to the tumbler does not leak to the environment. The speed of the tumbler was set to 10 rounds/min and the ozone generator was set to producing 400 g of ozone per hour. The concentration in air of the ozone gas supplied to the chamber was monitored with an ozone gas measurement unit, and it was about 40 gr ozone/$Nm^3$. This experiment was repeated several times by varying each time the time duration of the ozone treatment of the garments inside the tumbler, from 15 min (minutes) to 60 min. The shrinkage, meaning the percent (%) change of the length and width of garments treated as above, and of garments not treated by ozone, upon subsequent several washing of the garments according to the TM31 test, is shown in Table 1 from which it is evident that the ozone treatment inhibits the shrinkage of the garments.

TABLE 1

| | Width | Length |
|---|---|---|
| Untreated | −23.33% | −23.33% |
| Ozone, 15 min | −11.67% | −11.67% |
| Ozone, 30 min | −8.33% | −8.33% |
| Ozone, 45 min | −8.33% | −8.33% |
| Ozone, 60 min | −3.33% | −3.33% |

Example 2

The same parameters as in example 1 were used, with the difference that the duration of the ozone treatment of the garments was fixed to 30 min, and that the ozone generator was controlled as to vary from 20 g/Nm$^3$ to 120 g/Nm$^3$ the concentration in air of the ozone gas supplied to the rotative tumbler. The shrinkage of the garments was tested similarly to example 1, and is shown in Table 2 from which it is evident that the method prevents the change of the width and length of the garments, especially when the ozone concentration is higher than 20 g/Nm3.

TABLE 2

| | Width | Length |
|---|---|---|
| Untreated | −26.09% | −5.08% |
| Ozone 20 g/Nm$^3$ | −31.25% | −3.39% |
| Ozone 40 g/Nm$^3$ | −11.11% | −8.33% |
| Ozone 80 g/Nm$^3$ | −8.89% | −5.00% |
| Ozone 120 g/Nm$^3$ | −4.44% | −5.00% |

Example 3

This example demonstrates the synergistic anti-shrinkage and anti-felting effect produced by the combination of ozone treatment and enzyme treatment of wool garments, and the use of said synergistic effect for reducing the duration of the overall treatment required, without compromising the anti-shrinkage and anti-felting effect obtained by the treatment. In this example, originally identical wool garments were treated with four different treatment variations: (i) standard washing with no ozone or enzyme treatments, (ii) ozone treatment, (iii) enzyme treatment, (iv) ozone treatment followed by enzyme treatment. The standard washing was performed using a household washing machine. The ozone treatment performed as in example 1 with the following modifications: the ozone concentration in air was 80 g/Nm$^3$ and for the variation (ii) the garments were treated with ozone for 60 min, while for the variation (iv) the garments were treated with ozone for 30 min. The enzyme treatment was performed by immersing for 15 min at ambient temperature the garments in an aqueous solution comprising the commercial product Savinase® 16.0 L, the quantity of the latter was adjusted so that the enzyme to garments concentration by weight was 0.25% for variation (iv), and 0.75% for variation (iii). The volume of the aqueous solution used for the enzyme treatment, was approximately 20 liters for every 1 Kg of garments immersed in it.

The shrinkage and felting of the garments after the application of repetitive home laundries, this is to say after repetitive domestic washing of the garments, which happened after each of the above treatment variations was inspected visually and also quantitatively. The visual inspection showed that the treatment variation (iv) was the best in preventing shrinkage and felting in comparison to the other variation (i), (ii) and (iii). The quantitative inspection was based on measuring the weight of pieces of the garments before and after the garments were subjected to said repetitive home laundries. The area of each piece was 5 cm$^2$. By comparing the weight of said pieces of the garments before and after said repetitive laundries, it is possible to extract conclusions regarding whether the treatment applied before the repetitive laundries prevented shrinkage and felting of the garments during the repetitive laundries. An increase of the weight of the pieces after repetitively laundering the garments compared to the weight before repetitively laundering the garments, indicates the occurrence of felting and shrinkage, and the higher said increase is the more felting and shrinkage has been caused by the repetitive laundering, which means the least effective the treatment variation has been in inhibiting said felting and shrinkage. The increase in weight is expressed as a percent (%) positive number. The results of such measurements are shown in Table 3. From the data of Table 3, it is evident that although in (iv) a smaller concentration of enzyme was used compared to (iii), the anti-felting and anti-shrinkage effect achieved by (iv) was better, as evident by the smaller % increase in weight for (iv) compared to (iii). Similarly, the anti-shrinkage and anti-felting effect achieved by the treatment variation (iv) was almost identical compared to the same effects achieved by the variation (ii), despite the fact that the duration of the ozone treatment in (iv) was half compared to the duration of the ozone treatment in (ii).

TABLE 3

| | Weight of 5 cm$^2$ piece of fabric of garment | | |
|---|---|---|---|
| Treatment variation | Before repetitive laundering (g) | After repetitive laundering (g) | Increase in weight |
| (i) Standard washing | 0.49 | 0.82 | 40% |
| (ii) Ozone treatment (80 g/Nm$^3$, 60 min) | 0.59 | 0.62 | 5% |
| (iii) Enzyme treatment (0.75% Savinase ®) | 0.43 | 0.5 | 14% |
| (iv) Ozone treatment (80 g/Nm$^3$, 30 min) + Enzyme treatment (0.25% Savinase ®) | 0.57 | 0.61 | 7% |

Therefore, unambiguously a synergistic effect is produced by the combination of ozone treatment and enzyme treatment, and enzyme treatment is auxiliary to the ozone treatment and serves for reducing the required duration of the overall method and thus for improving the advantages and industrial applicability of the latter.

Example 4

Figure 3:
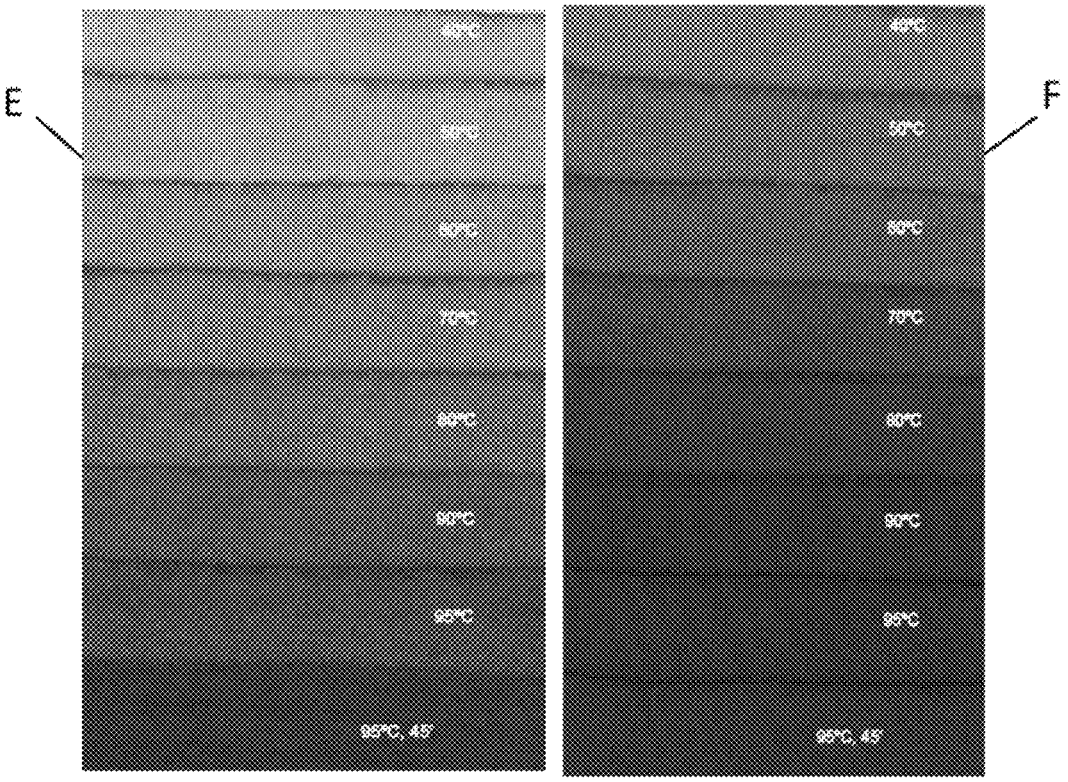
FIG. 3 is two photographs of wool textile samples dyed under different conditions, wherein one photograph shows samples which were treated according to an embodiment of the method of the invention, and the other photograph shows samples which were not treated according to the invention.

Similar parameters as in example 1 were used, with the ozone processing time fixed at 60 minutes and the ozone concentration fixed 40 g/Nm3, and the garments were additionally dyed with reactive dyestuff (Lanasol® family from HUNTSMAN company) different dyeing temperatures and for 20 minutes and 45 minutes (45'). The color of the dyed wool textile samples was visually inspected and compared. The dyed samples are shown in photograph F of FIG. 3. FIG. 3 also includes photograph E of samples which were dyed the same way as the samples of F but without treating the samples with ozone before dyeing them. It is evident from FIG. 3 that the ozone treated samples of F absorbed more dye and for this reason they became darker compared to the samples of E.

The invention claimed is:

1. A method for the treatment of wool garments with ozone gas to control and inhibit their felting and shrinkage during their subsequent industrial finishing process and/or domestic washing care, which method comprises the steps of:

wetting the garments; and treating the garments inside the interior of a rotative tumbler for a time period of between 15 and 60 minutes at ambient temperature with ozone gas, said ozone gas being at a concentration in air of between 20 g ozone/Nm$^3$ and 150 g ozone/Nm$^3$, wherein the rotative tumbler is rotated at a speed of between 10 rounds/min and 25 rounds/min;

wherein the garments are wetted with water to a final water to garment concentration by weight of between 40% and 70%.

2. The method according to claim 1, wherein the ambient temperature is between 5° C. and 40° C.

3. The method according to claim 1, wherein the rotative tumbler interior volume to garments weight ratio is between 0.01 $m^3$/kg and 1 $m^3$/Kg.

4. The method according to claim 1, wherein the interior of the rotative tumbler inside which the garments are placed has a volume between 0.1 $m^3$ and 10 $m^3$.

5. The method according to claim 1, which further comprises rinsing the garments with water after treating them with ozone gas.

6. The method according to claim 1, which further comprises the following steps:

wetting the garments with a mixture comprising water and at least one enzyme;

waiting for a time period for said at least one enzyme to act on a surface of the garments; and stopping an action of the at least one enzyme.

7. The method according to claim 6, wherein the at least one enzyme to garments concentration by weight is between 0.01% and 20%.

8. The method according to claim 6, wherein the time period for said at least one enzyme to act on the surface of the garments is between 1 minute and 60 minutes.

9. The method according to claim 6, wherein the mixture comprising water and at least one enzyme has a temperature between 5° C. and 53° C.

10. The method according to claim 6 wherein the at least one enzyme is a protease.

11. The method according to claim 6, wherein stopping the action of the at least one enzyme is being done by rinsing the garments with water, and/or by heating the garments and/or the mixture comprising water and at least one enzyme to a temperature between 30° C. to 95° C.

12. The method according to claim 1, further comprising dyeing the garments.

13. The method according to claim 1, further comprising any of the following steps and combinations thereof: drying the garments; washing the garments; treating the garments with softeners and/or detergents and/or deodorizers.

14. A method according to claim 1, wherein wool garment is made of a fabric comprising comb wool, or coarse wool, or wool with cashmere, or mohair, or animal fiber yarn, or wool blended with other non-wool fibers.

* * * * *